US006905371B2

(12) United States Patent
Yi-Tse

(10) Patent No.: US 6,905,371 B2
(45) Date of Patent: Jun. 14, 2005

(54) TERMINAL AND CONNECTOR USING SAME

(75) Inventor: Ho Yi-Tse, Tainan Hsien (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/255,201

(22) Filed: Sep. 26, 2002

(65) Prior Publication Data

US 2003/0060087 A1 Mar. 27, 2003

(30) Foreign Application Priority Data

Sep. 26, 2001 (TW) ..... 90216469 U
Sep. 26, 2001 (TW) ..... 90216470 U

(51) Int. Cl.[7] ..... H01R 33/00

(52) U.S. Cl. ..... 439/660; 439/630; 439/637; 439/746; 439/748; 439/862; 439/861; 439/858; 174/72 R

(58) Field of Search ..... 439/660, 630, 439/637, 746, 748, 862, 861, 858; 174/72 R

(56) References Cited

U.S. PATENT DOCUMENTS 3,707,696 A * 12/1972 Carter ..... 439/248
4,842,551 A * 6/1989 Heimann ..... 439/502
5,803,765 A * 9/1998 Peloza et al. ..... 439/567
6,004,160 A * 12/1999 Korsunsky et al. ..... 439/660
6,099,359 A * 8/2000 Yamamuro ..... 439/736
6,293,832 B1 * 9/2001 Yamamoto ..... 439/850

* cited by examiner

*Primary Examiner*—Dean A. Reichard
*Assistant Examiner*—Anton Harris
(74) *Attorney, Agent, or Firm*—Robert J. Zeitler

(57) ABSTRACT

This invention provides an improved terminal and a connector using the terminal. The connector includes an insulating housing and at least one conductive terminal. The insulating housing has an insert end, a connecting end opposite to the insert end, and at least one terminal passage extending through the insert end and the connecting end. The conductive terminal is received correspondingly in the terminal passage of the insulating housing, and has a securing portion that generates interference positioning with the insulating housing, a coupling portion connected to the securing portion and located proximate to the connecting end of the insulating housing, and at least two contact portions connected to the securing portion and located proximate to the insert end of the insulating housing such that the coupling portion connects electrically with an end portion of a corresponding lead wire, and the contact portions contact electrically corresponding terminals of a matching electrical connector. By forming more than one contact portion on the conductive terminal, signals of equivalent voltage can be provided to the corresponding terminals of the matching electrical connector to thereby enhance assembly efficiency and signal transmission stability.

24 Claims, 7 Drawing Sheets

PRIOR ART

TERMINAL AND CONNECTOR USING SAME

FIELD OF THE INVENTION

The invention relates to a terminal used in a connector, and more particularly to a wire connector used for connecting power lead wires, and having a single conductive terminal with at least two contact portions of equivalent voltage so as to enhance stability of electrical contact.

BACKGROUND OF THE INVENTION

FIG. 1 illustrates a conventional wire connector 1. The wire connector 1 includes an insulating housing 11 and a plurality of conductive terminals 12 that are received side by side in the insulating housing 11 such that the insulating housing 11 has an insert end 111 and a connecting end 112 disposed in an opposite direction, wherein the insert end 111 can be connected to a matching electrical connector (not shown) to enable one end of the conductive terminal 12 in the insert end 111 to electrically contact the corresponding terminal in the matching electrical connector, while the connecting end 112 can contact the first end portions 21 of a plurality of lead wires 2, whereby the conductive terminals 12 in the connecting end 112 can respectively and electrically connect with the corresponding lead wires 2. As the function of such a wire connector 1 generally is to provide connection of power signals of different voltages, a second end portion 22 at the other end of each lead wire 2 is secured in a connector 3, and the connector 3 can be electrically coupled to a power supply device (not shown). Therefore, the lead wires 2 can respectively provide power signals of different voltages (such as 12V, 5V, 0V, etc.). Supply of different power signals can be integrated by means of the wire connector 1.

However, as a general practice, since the power signals provided by a certain number of the conductive terminals 12 in the insulating housing 11 are of the same voltage, and since the conductive terminals 12 are independent of each other, the conductive core wires within the first end portions 21 of the lead wires 2 that provide the voltage power signals have to be first divided into strands of coupling ends that correspond in number to the conductive terminals 12 to be connected and then connected electrically to the conductive terminals 12, respectively. Therefore, in terms of assembly, not only the conductive terminals 12 have to be disposed in the insulating housing 11 one by one, the conductive terminals 12 that provide the same voltage have to be connected electrically to the corresponding lead wires 2, respectively. The assembly process is quite complicated and inconvenient. The manufacturing cost is also increased. On the other hand, since the respective conductive terminals 12 will exhibit different contact characteristics when they electrically contact the corresponding terminals of the matching electrical connector due to assembly or the material thereof, when contact of one of the conductive terminals 12 is defective so that the contact resistance value increases to result in a heat generation phenomenon, because the respective conductive terminals 12 are independent of each other, the heat generated is likely to concentrate to result in a temperature rise, thereby making the transmission of power signals unstable, which will affect the performance of the wire connector 1.

SUMMARY OF THE INVENTION

Therefore, the primary object of the invention is to provide a single conductive terminal having more than one contact portion of equivalent voltage so as to enhance assembly efficiency and distribute uniformly the heat generated as a result of contact to thereby lower temperature, and a connecter using such a terminal.

Accordingly, the connector of the invention includes an insulating housing and at least one conductive terminal. The insulating housing has an insert end, a connecting end opposite to the insert end, and at least one terminal passage extending through the insert end and the connecting end. The conductive terminal is received correspondingly in the terminal passage of the insulating housing, and has a securing portion that generates interference positioning with the insulating housing, a coupling portion connected to the securing portion and located proximate to the connecting end of the insulating housing, and at least two contact portions connected to the securing portion and located proximate to the insert end of the insulating housing such that the coupling portion connects electrically with an end portion of a corresponding lead wire, and the contact portion contacts electrically a corresponding terminal of a matching electrical connector.

The terminal may also include positioning segments received within grooves to retain the distal end of the terminal within the terminal passage.

The securing portion of the terminal may also be received within a groove to retain the securing portion of the terminal within the terminal passage.

The grooves receiving the positioning segments and the securing portions may be of different configurations.

The contact portion of the terminal may also include an abutting segment.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 1:
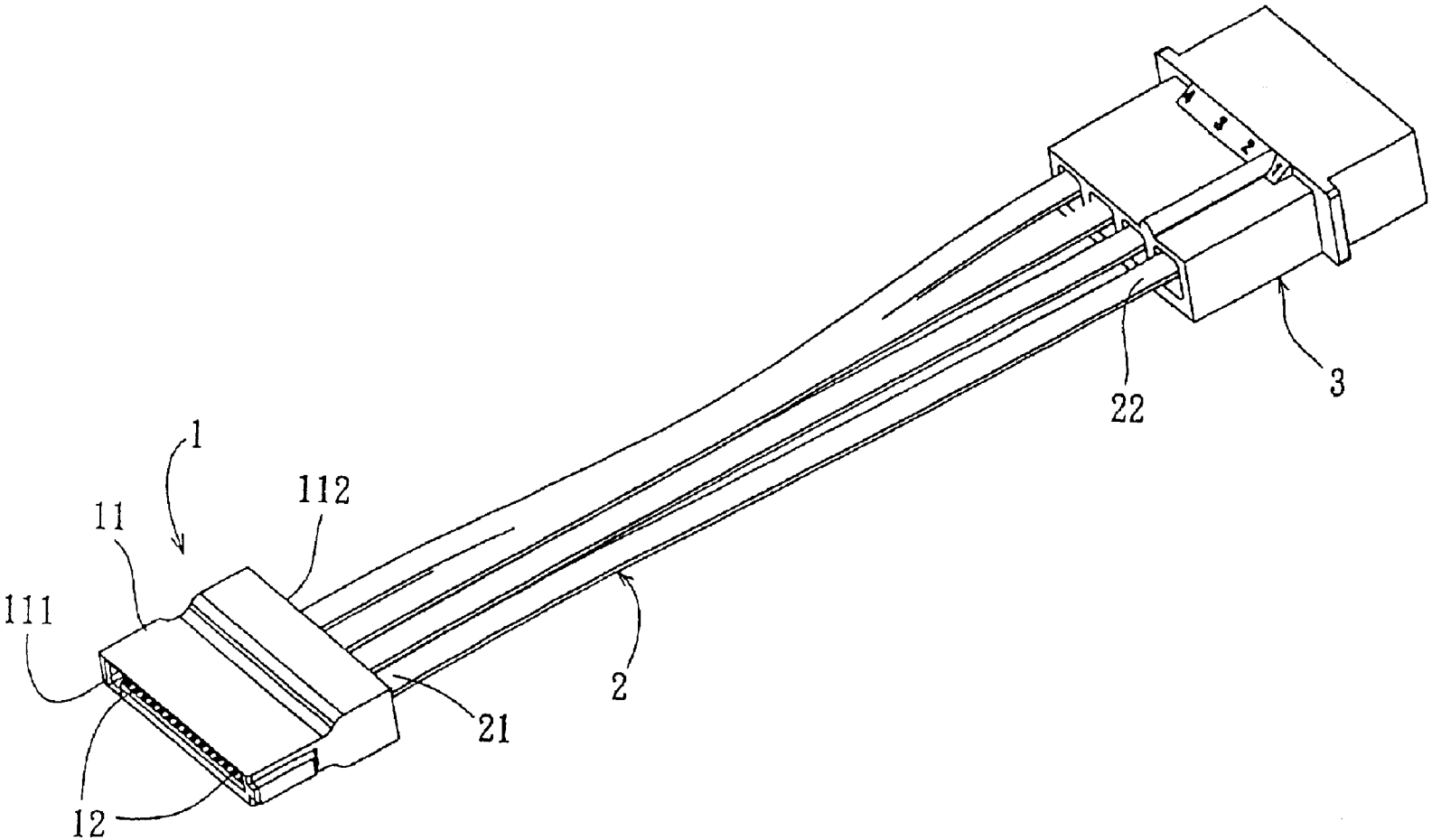
FIG. 1 is a schematic view of a conventional wire connection in a state of use.

While the invention may be susceptible to embodiment in different forms, there is shown in the drawings, and herein will be described in detail, certain embodiments with the understanding that the present disclosure is to be considered an exemplification of the principles of the invention, and is not intended to limit the invention to that as illustrated and described herein.

Figure 2:
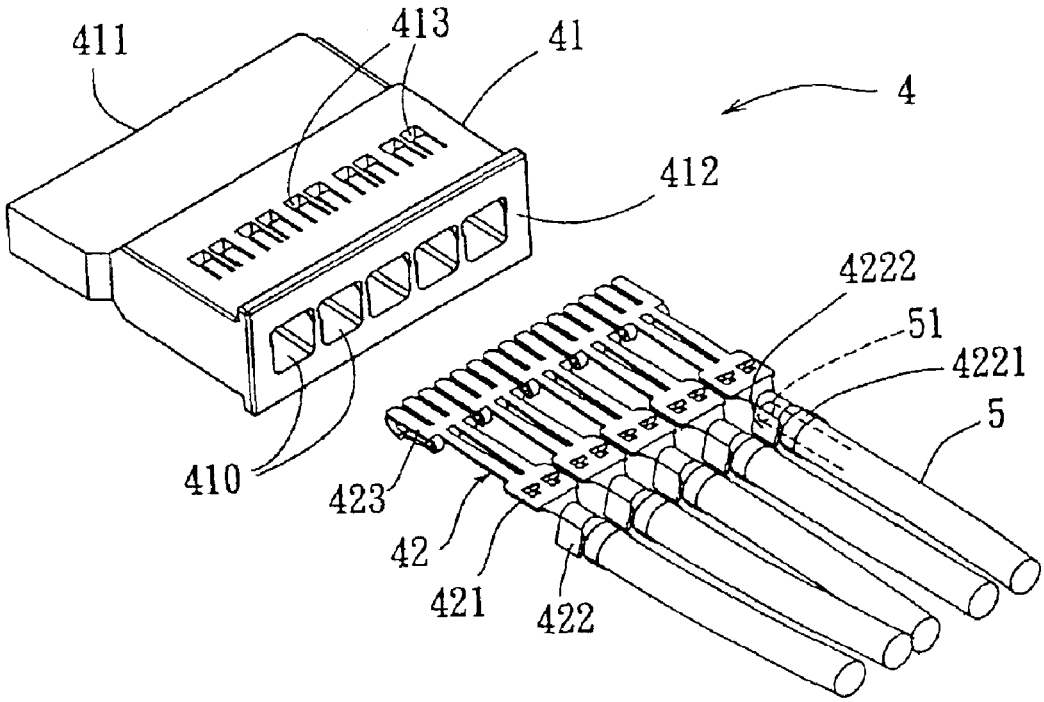
FIG. 2 is an exploded perspective view of a first embodiment of a connector according to the invention.

Referring to FIG. 2, one embodiment of a wire connector 4 according to the present invention is shown to include an insulating housing 41 and more than one conductive terminal 42. In this embodiment, the insulating housing 41 can accommodate five conductive terminals 42 therein at the same time.

The insulating housing 41 has an insert end 411, a connecting end 412 opposite to the insert end 411, and terminal passages 410 that correspond in number to the conductive terminals 42 and that extend through the insert end 411 and the connecting end 412. The insert end 411 is disposed to couple with a matching electrical connector (not shown). The connecting end 412 is disposed to receive an end portion of a lead wire 5.

Figure 6:
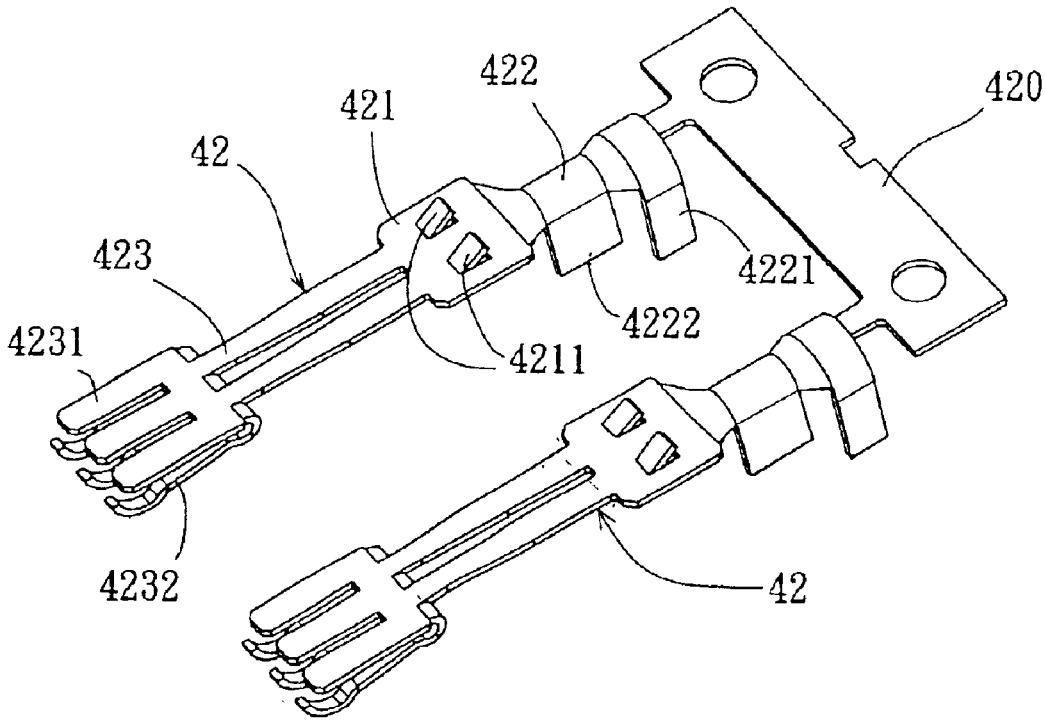
FIG. 6 is a schematic view of two conductive terminals formed on a metal material strip in the first embodiment, illustrating the configuration of the conductive terminal.
Figure 7:
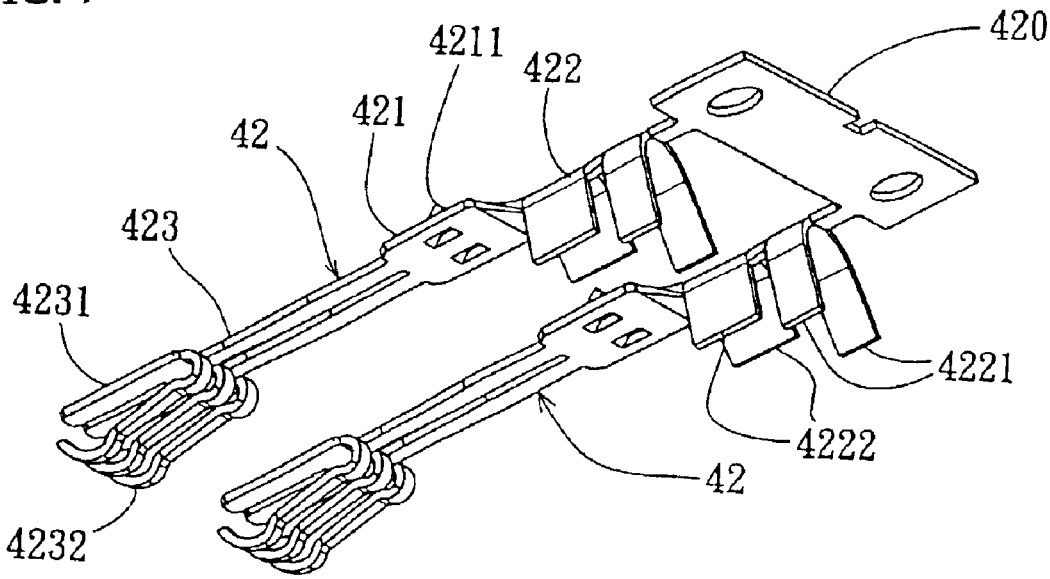
FIG. 7 is a schematic view of FIG. 6 taken from another angle.
Figure 8:
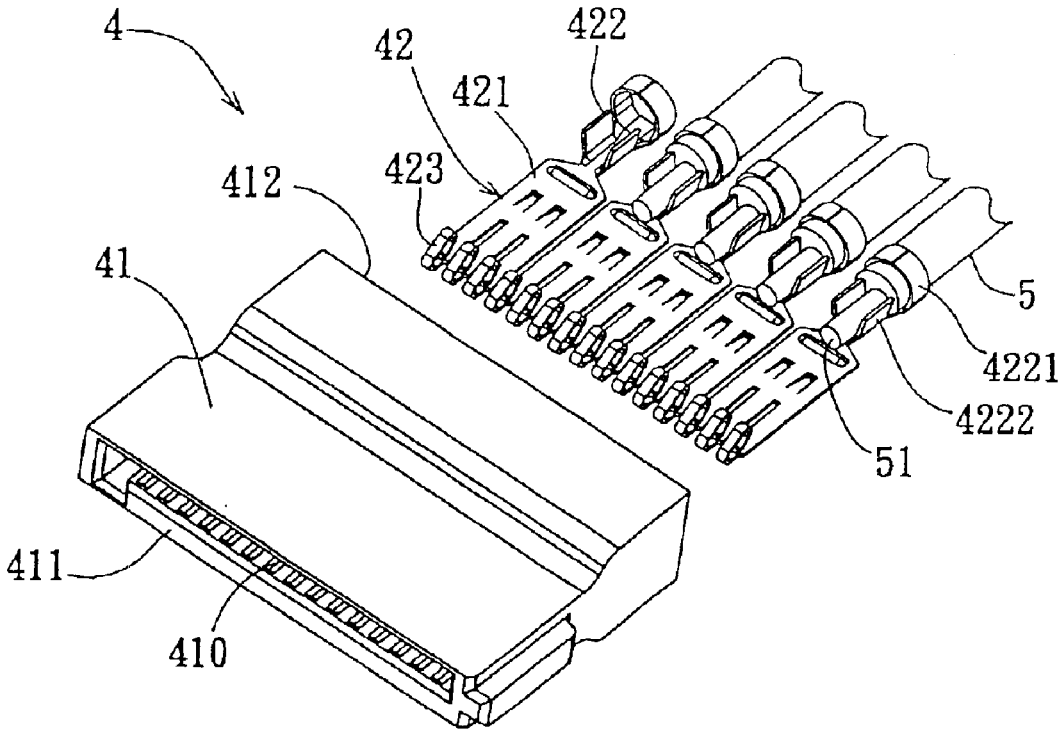
FIG. 8 is an exploded perspective view of an alternative embodiment of a connector according to the invention.
Figure 12:
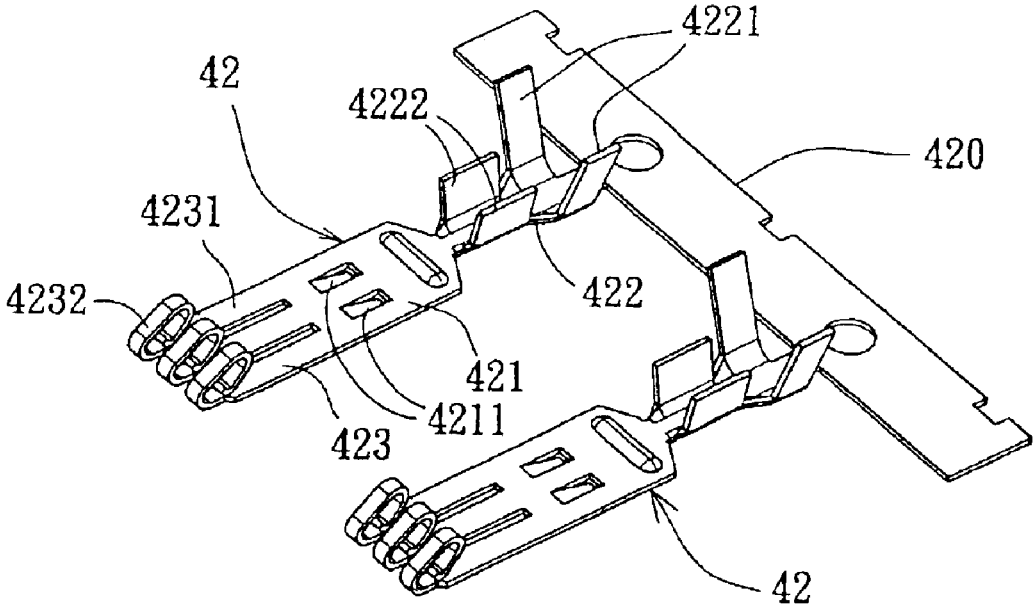
FIG. 12 is a schematic view of two conductive terminals formed on a metal material strip in the alternative embodiment, illustrating the configuration of the conductive terminal.
Figure 13:
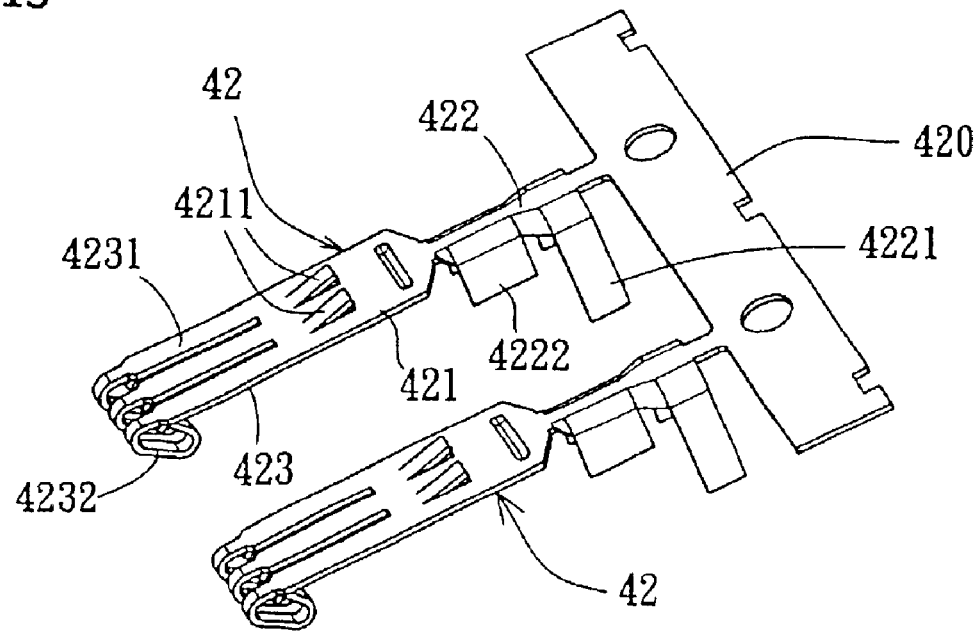
FIG. 13 is a schematic view of FIG. 12 taken from another angle.

Referring further to FIGS. 6 and 7, the conductive terminal 42 is a sheet member that is formed on a metal material strip 420 by punching and then removed from the metal material strip 420, and is received in the corresponding terminal passage 410 of the insulating housing 41. The conductive terminal 42 has a securing portion 421, a coupling portion 422 connected to one lateral edge of the securing portion 421, and at least two contact portions 423 that are both connected to the other lateral edge of the securing portion 421. In this embodiment, the securing portion 421 has two positioning protruding spikes 4211 that project inclinedly in the direction of the coupling portion 422. The coupling portion 422 is formed with a pair of symmetrical securing clamp plates 4221 and a pair of symmetrical connecting clamp plates 4222. Further, the contact portion 423 has a positioning segment 4231 that extends outwardly from the securing portion 421, and an abutting segment 4232 that is bent from one end of the positioning segment 4231 which is proximate to the securing portion 421 at the middle in a direction away from the securing portion 421 such that the abutting segment 4232 has a protruding spaced-apart distance relative to the positioning segment 4231. In the embodiment shown in FIGS. 12 and 13, the contact portion 423 has a positioning segment 4231 that extends outwardly from the securing portion 421, and an abutting segment 4232 that bends from a distal end of the positioning segment 4231 which is farthest away from the securing portion 421 in an opposite direction toward the securing portion 421 such that the abutting segment 4232 forms a protruding configuration relative to the positioning segment 4231.

As shown in FIG. 2, during assembly, the coupling portion 422 of each conductive terminal 42 is connected to the corresponding lead wire 5, and is secured by means of the two opposing securing clamp plates 4221 that are bent to form a clamping ring that clamps tightly the outer surface of the end portion of the lead wire 5 with the insulating material, and by means of the two opposing connecting clamp plates 4222 that are bent to clamp securely the conductive core wire 51 within the lead wire 5 which is exposed after stripping of the insulating material, thereby establishing electrical connection between the conductive terminal 42 and the lead wire 5. Referring once again to FIG. 3, the conductive terminal 42 is inserted via the connecting end 412 of the insulating housing 41 and is received in the corresponding terminal passage 410 in the insulating housing 41, and the insulating housing 41 is provided with a positioning hole 413 corresponding to the positioning protruding spike 4211 in a substantially central portion thereof.

When the conductive terminal 42 is inserted into the terminal passage 410 at a specific position, the positioning protruding spike 4211 can extend into the corresponding positioning hole 413. Due to the interference between the positioning protruding spike 4211 and the positioning hole 413, the conductive terminal 42 is unable to withdraw from the connecting end 412 of the insulating housing 41 in an opposite direction, and can thus achieve the effect of positioning with the insulating housing 41. After the conductive terminal 42 is received in the terminal passage 410, the coupling portion 422 of the conductive terminal 42 is located in a position proximate to the connecting end 412, and the contact portion 423 is located in a position proximate to the insert end 411.

The abutting segment 4232 of the contact portion 423 forms an inclined protruding configuration relative to the positioning segment 4231 such that the abutting segment 4232 is capable of elastic deformation and is capable of electrical contact with the corresponding terminal of the matching electrical connector. Therefore, by virtue of providing two or more than two contact portions 423 on the conductive terminal 42, power signals of equivalent voltage can be provided to two or more than two corresponding terminals of a matching electrical connector simultaneously, and the conductive terminals 42 per se can connect directly with the corresponding lead wires 5, thereby eliminating the complicated process of having to divide the conductive core wires of the lead wires beforehand and connect the same with individual conductive terminals respectively thereafter as in the prior art. The assembly efficiency can thus be enhanced considerably.

In addition, once the contact between any of the contact portions 423 of the conductive terminal 42 and the corresponding terminal of the matching electrical connector is defective to result in the generation of heat, since the plurality of contact portions 423 are inter-connected on the same conductive terminal 42, occurrence of heat concentration on a single conductive terminal as in the prior art is relatively unlikely. On the contrary, the heat can be distributed evenly all over the conductive terminal 42. The probability of excessive rise in temperature can certainly be reduced to a large extent, and the stability of the electrical connector 4 in transmitting electric currents can be maintained.

Figure 3:
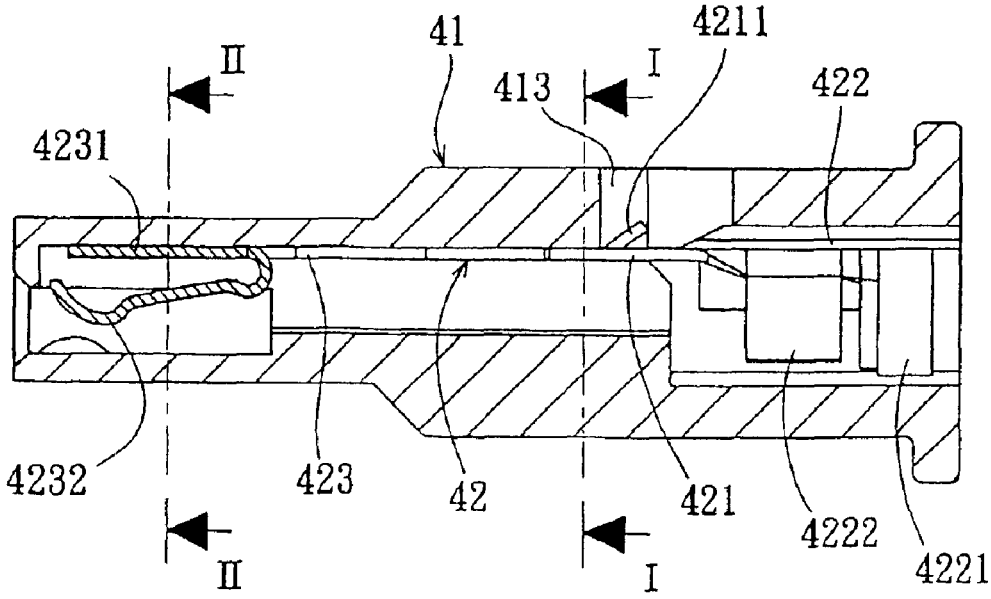
FIG. 3 is an assembled sectional view of the first embodiment, illustrating the assembly relationship of a conductive terminal received in a terminal passage of an insulating housing.
Figure 4:
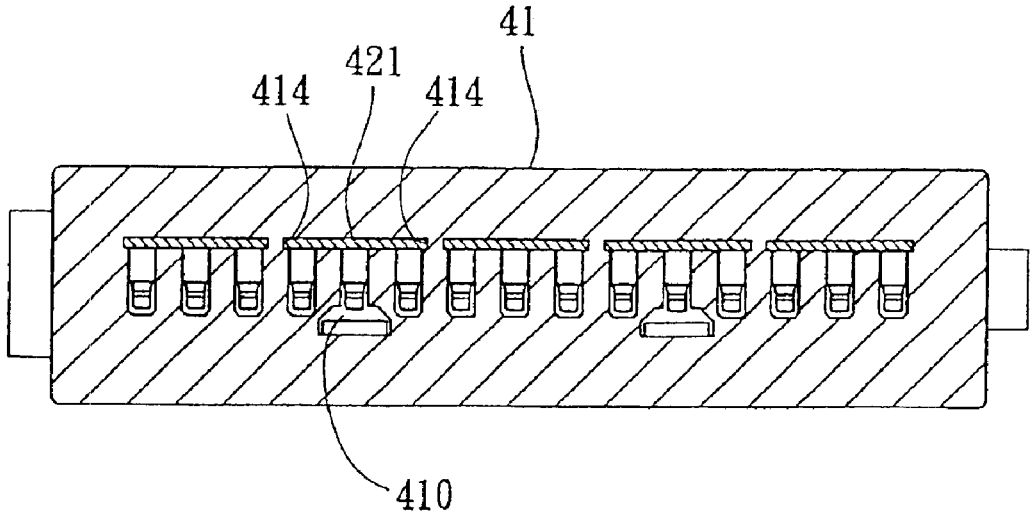
FIG. 4 is a schematic sectional view taken along line I—I of FIG. 3.
Figure 5:
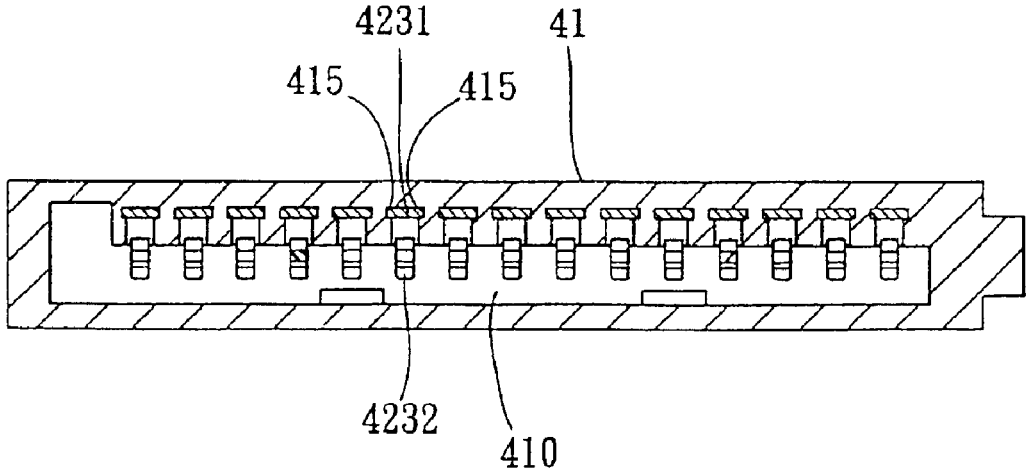
FIG. 5 is a schematic sectional view taken along line II—II of FIG. 3.

Referring once again to FIGS. 3 and 4, in order to enhance positioning of the conductive terminal 42 and the insulating housing 41 relative to each other, the terminal passages 410 of the insulating housing 41 is further provided with first insert grooves 414 that correspond in thickness to the two lateral edges of the securing portion 421 of the conductive terminal 42. When the conductive terminal 42 is inserted into the terminal passage 410, the two lateral edges of the securing portion 421 of the conductive terminal 42 can fit into the corresponding first insert grooves 414 so that the securing portion 421 is restrained by the first insert grooves 414 and will not deviate in upward and downward directions as in the Figures relative to the insulating housing 41. Further, as shown in FIGS. 3 and 5, the terminal passage 410 of the insulating housing 41 may be further provided with second insert grooves 415 corresponding to the two lateral edges of the individual positioning segments 4231 of the contact portion 423 of the conductive terminal 42. When the conductive terminal 42 is inserted into the terminal passage 410, in addition to the securing portion 421 that is positioned by the first insert grooves 414, the two lateral edges of the positioning segment 4231 of each contact portion 423 can also fit into the corresponding second insert grooves 415. By means of restraining the positioning segment 4231 by the second insert grooves 415, the contact portion 423 is prevented from deviating in upward and downward directions as in the Figures relative to the insulating housing 41.

Further, as shown in FIG. 3, since the abutting segment 4232 of the contact portion 423 of the conductive terminal 42 is a protruding configuration that bends from the end of the positioning segment 4231 that is proximate to the securing portion 421 in a direction away from the securing portion 421, when the abutting segment 4232 contacts the corresponding terminal of the matching electrical connector, the part that protrudes to the farthest extent constitutes a major contact point, and the part of the abutting segment 4232 that connects with and that bends from the positioning segment 4231 constitutes a pivot point. When the contact point is subjected to a pressure, the abutting segment 4232 will rotate with the pivot point as center and deform. Since the linear distance from the contact point to the pivot point is relatively long, in actual application, the abutting segment 4232 can have a relatively large elastic deformation. Therefore, the abutting segment 4232 can have better elasticity when electrically contacting the corresponding terminal of the matching electrical connector, which can help enhancing the contact characteristics of both of them.

Figure 9:
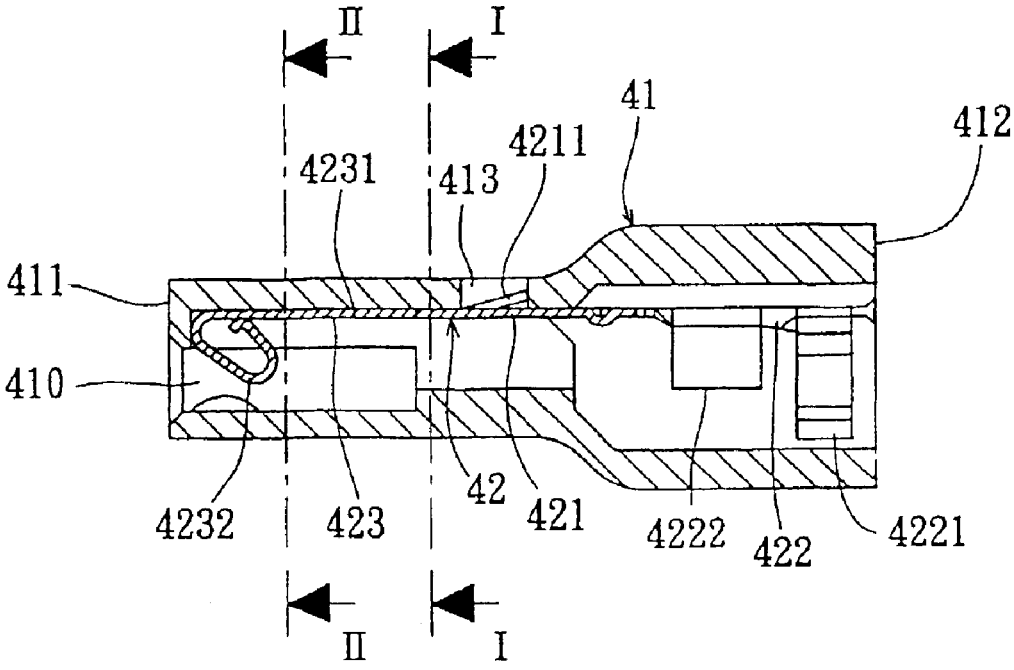
FIG. 9 is an assembled sectional view of the alternative embodiment, illustrating the assembly relationship of a conductive terminal received in a terminal passage of an insulating housing.
Figure 10:
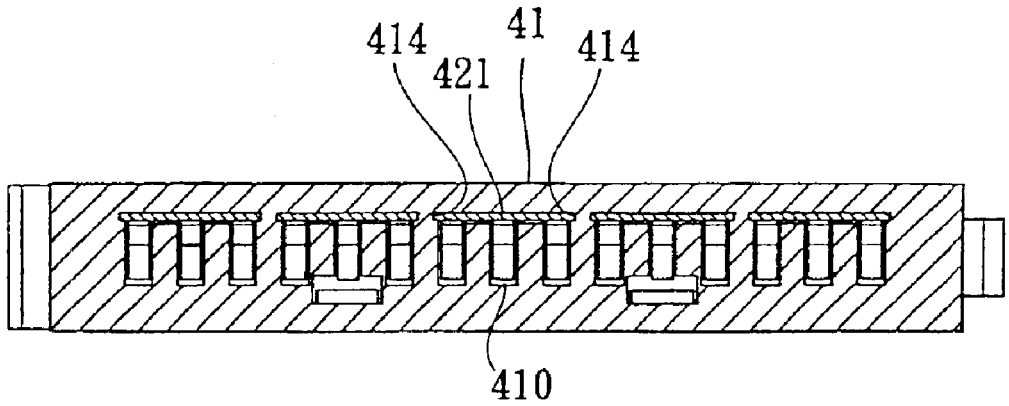
FIG. 10 is a schematic sectional view taken along line I—I of FIG. 9.
Figure 11:
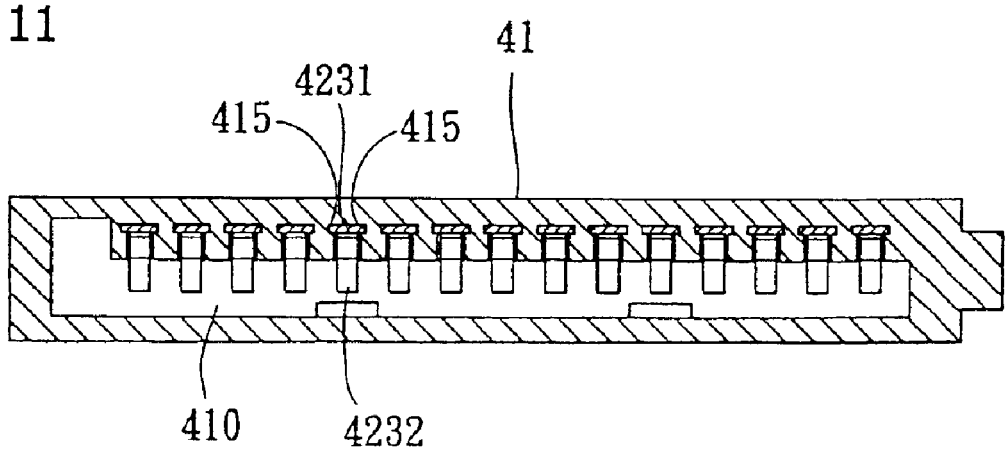
FIG. 11 is a schematic sectional view taken along line II—II of FIG. 9.

As shown in the embodiment of FIG. 9, since the abutting segment 4232 of the contact portion 423 of the conductive terminal 42 is a protruding configuration that bends from the distal end of the positioning segment 4231 that is remote from the securing portion 421 in a direction toward the securing portion 421, when the abutting segment 4232 contacts the corresponding terminal of the matching electrical connector, the part of the abutting segment 4232 that protrudes to the farthest extent relative to the positioning segment 4231 constitutes a major contact point, and the part of the abutting segment 4232 that connects with and that bends from the positioning segment 4231 constitutes a pivot point. When the contact point is subjected to a pressure, the abutting segment 4232 will rotate with the pivot point as center and deform. Since the linear distance from the contact point to the pivot point is relatively long, in actual application, the abutting segment 4232 can have a relatively large deformation-resisting force. Therefore, the abutting segment 4232 can have a relatively large contact positive force when electrically contacting the corresponding terminal of the matching electrical connector, which can help enhancing the contact characteristics of both of them.

While the illustrated embodiments of the present invention are shown and described, it is envisioned that those skilled in the art may devise various modifications of the present invention without departing from the spirit and scope of the appended claims.

What is claimed is:

1. A connector capable of being connected electrically to at least one lead wire, the connector comprising:

an insulating housing having an insert end for mating with a mating connector, a connecting end opposite to the insert end for receiving an end portion of the lead wire, and at least one terminal passage extending from the connecting end to the insert end; and at least one conductive terminal received correspondingly in the terminal passage of the insulating housing, the conductive terminal having a securing portion, a coupling portion connected to the securing portion and located proximate to the connecting end of the insulating housing, and a plurality of contact portions connected to the securing portion and located proximate to the insert end of the insulating housing, wherein the contact portion has a positioning segment that extends from the securing portion in a direction toward the insert end of the insulating housing, and a substantially protruding abutting segment that bends from one end of the positioning segment which is proximate to the securing portion in a direction away from the securing portion.

2. A connector capable of being connected electrically to at least one lead wire, the connector comprising:

an insulating housing having an insert end for mating with a mating connector, a connecting end opposite to the insert end for receiving an end portion of the lead wire, and at least one terminal passage extending from the connecting end to the insert end; and at least one conductive terminal received correspondingly in the terminal passage of the insulating housing, the conductive terminal having a securing portion, a coupling portion connected to the securing portion and located proximate to the connecting end of the insulating housing, and a plurality of contact portions connected to the securing portion and located proximate to the insert end of the insulating housing, wherein the contact portion has a positioning segment that extends from the securing portion in a direction toward the insert end of the insulating housing, and a substantially protruding abutting segment that bends from one end of the positioning segment which is farthest away from the securing portion in a direction toward the securing portion.

3. The connector as claimed in claim 1, wherein the coupling portion of the conductive terminal has a pair of securing clamp plates for clamping an outer surface of the lead wire, and a pair of connecting clamp plates for clamping and contacting electrically a conductive core wire within the lead wire.

4. The connector as claimed in claim 1, wherein the terminal passage of the insulating housing is further provided with first insert grooves corresponding to two lateral edges of the securing portion of the conductive terminal for insertion thereof, such that the securing portion is restrained by the first insert grooves and will not deviate relative to the insulating housing.

5. The connector as claimed in claim 4, wherein the terminal passage of the insulating housing is further provided with second insert grooves corresponding to two lateral edges of the positioning segment of the contact portion of the conductive terminal for insertion thereof, such that the positioning segment of the contact portion is restrained by the second insert grooves and will not deviate relative to the insulating housing.

6. The connector as claimed in claim 1, wherein the conductive terminal has three contact portions.

7. A terminal for use in a connector having an insulating housing, the insulating housing receiving the terminal, the terminal comprising a securing portion, a coupling portion and plurality of contact portions, the securing portion being located between the coupling portion and the plurality of contact portions, wherein the contact portion has a positioning segment that extends from the securing portion in a direction toward the insert end of the insulating housing, and a substantially protruding abutting segment that bends from one end of the positioning segment which is farthest away from the securing portion in a direction toward the securing portion.

8. The terminal as claimed in claim 7, wherein the coupling portion of the conductive terminal has a pair of securing clamp plates for clamping an outer surface of the lead wire, and a pair of connecting clamp plates for clamping and contacting electrically a conductive core wire within the lead wire.

9. The terminal as claimed in claim 7, wherein the terminal passage of the insulating housing is further provided with first insert grooves corresponding to two lateral edges of the securing portion of the conductive terminal for insertion thereof, such that the securing portion is restrained by the first insert grooves and will not deviate relative to the insulating housing.

10. The terminal as claimed in claim 9, wherein the terminal passage of the insulating housing is further provided with second insert grooves corresponding to two lateral edges of the positioning segment of the contact portion of the conductive terminal for insertion thereof, such that the positioning segment of the contact portion is restrained by the second insert grooves and will not deviate relative to the insulating housing.

11. A terminal for use in a connector having an insulating housing, the insulating housing receiving the terminal, the terminal comprising a securing portion, a coupling portion and plurality of contact portions, the securing portion being located between the coupling portion and the plurality of contact portions, wherein the contact portion has a positioning segment that extends from the securing portion in a direction toward the insert end of the insulating housing, and a substantially protruding abutting segment that bends from one end of the positioning segment which is proximate to the securing portion in a direction away from the securing portion.

12. The connector as claimed in claim 1, wherein each of the contact portions are physically separated from each other.

13. The terminal as claimed in claim 7, wherein each of the contact portions are physically separated from each other.

14. The terminal as claimed in claim 11, wherein each of the contact portions are physically separated from each other.

15. The connector as claimed in claim 2, wherein the coupling portion of the conductive terminal has a pair of securing clamp plates for clamping an outer surface of the lead wire, and a pair of connecting clamp plates for clamping and contacting electrically a conductive core wire within the lead wire.

16. The connector as claimed in claim 2, wherein the terminal passage of the insulating housing is further provided with first insert grooves corresponding to two lateral edges of the securing portion of the conductive terminal for insertion thereof, such that the securing portion is restrained by the first insert grooves and will not deviate relative to the insulating housing.

17. The connector as claimed in claim 16, wherein the terminal passage of the insulating housing is further provided with second insert grooves corresponding to two lateral edges of the positioning segment of the contact portion of the conductive terminal for insertion thereof, such that the positioning segment of the contact portion is restrained by the second insert grooves and will not deviate relative to the insulating housing.

18. The terminal as claimed in claim 11, wherein the coupling portion of the conductive terminal has a pair of securing clamp plates for clamping an outer surface of the lead wire, and a pair of connecting clamp plates for clamping and contacting electrically a conductive core wire within the lead wire.

19. The terminal as claimed in claim 11, wherein the securing portion of the conductive terminal has at least one positioning protruding spike that projects inclinedly toward the coupling portion, the insulating housing being provided with a positioning hole in a position corresponding to the positioning protruding spike, the protruding spike extending into the positioning hole to generate interference.

20. The terminal as claimed in claim 11, wherein the terminal passage of the insulating housing is further provided with first insert grooves corresponding to two lateral edges of the securing portion of the conductive terminal for insertion thereof, such that the securing portion is restrained by the first insert grooves and will not deviate relative to the insulating housing.

21. The terminal as claimed in claim 20, wherein the terminal passage of the insulating housing is further provided with second insert grooves corresponding to two lateral edges of the positioning segment of the contact portion of the conductive terminal for insertion thereof, such that the positioning segment of the contact portion is restrained by the second insert grooves and will not deviate relative to the insulating housing.

22. The terminal as claimed in claim 7, wherein the securing portion of the conductive terminal has at least one positioning protruding spike that projects inclinedly toward the coupling portion, the insulating housing being provided with a positioning hole in a position corresponding to the positioning protruding spike, the protruding spike extending into the positioning hole to generate interference.

23. The connector as claimed in claim 2, wherein each of the contact portions are physically separated from each other.

24. The connector as claimed in claim 2, wherein the conductive terminal has three contact portions.

* * * * *